US009115415B2

(12) United States Patent
Okamoto et al.

(10) Patent No.: US 9,115,415 B2
(45) Date of Patent: Aug. 25, 2015

(54) CASE HARDENED STEEL AND METHOD FOR PRODUCING SAME

(75) Inventors: Nariaki Okamoto, Kobe (JP); Mutsuhisa Nagahama, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 368 days.

(21) Appl. No.: 13/823,814

(22) PCT Filed: Aug. 10, 2011

(86) PCT No.: PCT/JP2011/068239
§ 371 (c)(1),
(2), (4) Date: Mar. 15, 2013

(87) PCT Pub. No.: WO2012/043074
PCT Pub. Date: Apr. 5, 2012

(65) Prior Publication Data

US 2013/0174943 A1 Jul. 11, 2013

(30) Foreign Application Priority Data

Sep. 28, 2010 (JP) ..... 2010-217060

(51) Int. Cl.
*C21D 8/00* (2006.01)
*C21D 1/06* (2006.01)
(Continued)

(52) U.S. Cl.
CPC ..... *C21D 8/005* (2013.01); *B22D 11/225* (2013.01); *C21D 1/06* (2013.01); *C21D 8/0226* (2013.01); *C21D 8/0247* (2013.01); *C21D 9/28* (2013.01); *C21D 9/40* (2013.01); *C22C 38/001* (2013.01); *C22C 38/002* (2013.01); *C22C 38/02* (2013.01); *C22C 38/04* (2013.01); *C22C 38/06* (2013.01); *C22C 38/20* (2013.01); *C22C 38/22* (2013.01); *C22C 38/26* (2013.01); *C22C 38/28* (2013.01); *C22C 38/32* (2013.01); *C22C 38/42* (2013.01); *C22C 38/44* (2013.01); *C22C 38/48* (2013.01);
(Continued)

(58) Field of Classification Search
None
See application file for complete search history.

(56) References Cited

U.S. PATENT DOCUMENTS 4,634,573 A * 1/1987 Yanagiya et al. ..... 420/127
6,686,061 B2 * 2/2004 Jeong et al. ..... 428/684
(Continued)

FOREIGN PATENT DOCUMENTS

JP 9 78184 3/1997
JP 11 335777 12/1999
(Continued)

OTHER PUBLICATIONS

International Search Report Issued Nov. 1, 2011 in PCT/JP11/68239 Filed Aug. 10, 2011.

*Primary Examiner* — Deborah Yee
(74) *Attorney, Agent, or Firm* — Oblon, McClelland, Maier & Neustadt, L.L.P.

(57) ABSTRACT

A case hardened steel with excellent cold forgeability and excellent impact properties after case hardening processing contains C, Si, Mn, S, Cr, Al, Ti, Nb, B, and N, with the balance being iron and unavoidable impurities. Of precipitates containing Ti and/or Nb, precipitates having a size of not less than 20 $\mu m^2$ are at a number density of not more than 1.0/$mm^2$. Of precipitates containing Ti and/or Nb, precipitates having a size of more than 5 $\mu m^2$ and less than 20 $\mu m^2$ and containing Mn and S are at a number density of more than 0.7/$mm^2$ and not more than 3.0/$mm^2$. The ferrite fraction is more than 77% by area.

4 Claims, 2 Drawing Sheets

(51) Int. Cl.

| | |
|---|---|
| ***C21D 9/28*** | (2006.01) |
| ***C21D 9/40*** | (2006.01) |
| ***C22C 38/32*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/26*** | (2006.01) |
| ***C22C 38/28*** | (2006.01) |
| ***C22C 38/22*** | (2006.01) |
| ***C22C 38/20*** | (2006.01) |
| ***C22C 38/42*** | (2006.01) |
| ***C22C 38/44*** | (2006.01) |
| ***C22C 38/48*** | (2006.01) |
| ***C22C 38/50*** | (2006.01) |
| ***C22C 38/54*** | (2006.01) |
| ***C21D 8/02*** | (2006.01) |
| ***B22D 11/22*** | (2006.01) |

(52) U.S. Cl.
CPC ..... *C22C 38/50* (2013.01); *C22C 38/54* (2013.01); *C21D 2211/004* (2013.01)

(56) References Cited

U.S. PATENT DOCUMENTS

| | | | | |
|---|---|---|---|---|
| 2003/0106623 | A1 | 6/2003 | Jeong et al. | |
| 2012/0018063 | A1* | 1/2012 | Hashimura et al. ..... | 148/624 |
| 2013/0146181 | A1* | 6/2013 | Kubota ..... | 148/219 |

FOREIGN PATENT DOCUMENTS

| | | |
|---|---|---|
| JP | 2004 514792 | 5/2004 |
| JP | 2004 183064 | 7/2004 |
| JP | 2006 161142 | 6/2006 |
| JP | 2006 291335 | 10/2006 |
| JP | 2006 307270 | 11/2006 |
| JP | 2006 307271 | 11/2006 |
| JP | 2007 162128 | 6/2007 |
| JP | 2007 217761 | 8/2007 |
| JP | 2007 321211 | 12/2007 |

* cited by examiner

CASE HARDENED STEEL AND METHOD FOR PRODUCING SAME

TECHNICAL FIELD

The present invention relates to a case hardened steel to serve as a raw material for mechanical parts to be case hardened and used in transportation equipment such as automobiles, construction machines, other industrial machines, etc., and also to a method for producing the same. The present invention particularly relates to a case hardened steel that shows excellent impact properties and excellent cold forgeability when case hardened for gears (shafted gears, etc.), shafts, bearings, and CVT pulleys, and also to a method for producing the same.

BACKGROUND ART

With respect to mechanical parts used for automobiles, construction machines, and other various industrial machines, parts that are required to have particularly high strength are conventionally subjected to a surface-hardening heat treatment (case hardening treatment) such as carburizing, carbonitriding, or nitriding. For these applications, usually, case hardened steels specified by JIS, such as SCr, SCM, and SNCM, are used. The steel is formed into a desired part shape by machining such as cutting or forging and then subjected to a surface-hardening heat treatment as mentioned above, followed by a finishing process such as polishing, whereby a part is produced.

In recent years, in such mechanical parts, it has been desired to reduce the production cost, shorten the lead time, and reduce the $CO_2$ emission during production, for example. Accordingly, part-forming methods are being changed from conventional cutting or hot forging to cold forging, and excellent cold forgeability is thus required. In addition, in a case hardened steel specified by JIS, the coarsening of crystal grains occurs due to the surface-hardening heat treatment after cold forging. Thus, it is also important to suppress the coarsening of crystal grains. In order to solve the problem of the coarsening of crystal grains, there is a conventionally used technique in which elements such as Al, Nb, and Ti are added to finely disperse precipitates such as AlN, Nb (CN), and TiC, and such fine precipitates are used to stop the migration of the crystal grain boundary (e.g., Patent Documents 1 to 8).

Japanese Patent Application Laid-Open Publication Nos. 2007-217761, 2006-307271, 2006-307270, 2007-321211, 2004-183064, 11-335777, 2006-161142, and 2007-162128 each disclose that the coarsening of crystal grains can be prevented by controlling the number of Nb- and/or Ti-containing precipitates having a predetermined grain size or composition (carbides, carbon nitrides, etc.) within a predetermined range. Although the disclosures have some preventive effects on the coarsening of crystal grains, cold forgeability has not yet been sufficient.

SUMMARY OF THE INVENTION

Problems to be Solved by the Invention

The present invention has been accomplished in view of the above background. An object of the present invention is to provide a case hardened steel that has excellent cold forgeability while ensuring conventional equivalent properties for preventing the coarsening of crystal grains and also has excellent impact properties after a case hardening treatment, which are usually required for the mechanical parts mentioned above; and also provide a useful method for producing the case hardened steel.

Means for Solving the Problems

The case hardened steel of the present invention that has achieved the object mentioned above contains C: 0.05 to 0.3% (% by mass; hereinafter the same applies to chemical composition), Si: 0.01 to 0.6%, Mn: 0.20 to 1.0%, S: 0.001 to 0.025%, Cr: 1 to 2.5%, Al: 0.01 to 0.10%, Ti: 0.01 to 0.10%, Nb: 0.01 to 0.10%, B: 0.0005 to 0.005%, and N: 0.002 to 0.02%, with the balance being iron and unavoidable impurities, wherein, of precipitates containing Ti and/or Nb, precipitates having a size of not less than 20 $\mu m^2$ are at a number density of not more than 1.0/$mm^2$, wherein, of precipitates containing Ti and/or Nb, precipitates having a size of more than 5 $\mu m^2$ and less than 20 $\mu m^2$ and containing Mn and S are at a number density of more than 0.7/$mm^2$ and not more than 3.0/$mm^2$, and wherein the ferrite fraction is more than 77% by area.

It is also preferable that, as necessary, the case hardened steel of the present invention contains (a) Mo: not more than 2% (excluding 0%) or (b) Cu: not more than 0.1% (excluding 0%) and/or Ni: not more than 0.3% (excluding 0%). Depending on the kinds of elements contained, the properties of the case hardened steel are further improved.

The present invention also includes a method for producing the case hardened steel. The production method of the present invention is characterized in that a steel having the above chemical composition is subjected to casting at a cooling rate of not less than 2.5° C./min from 1500° C. to 800° C., blooming at a heating temperature of 1100 to 1200° C., first hot rolling at a rolling temperature of 970 to 1150° C., then cooling to $Ac_3$ to 950° C., and further second hot rolling at a rolling temperature of $Ac_3$ to 950° C.

Effect of the Invention

According to the present invention, the chemical composition of the steel is adjusted to a predetermined range, and also the form (size) and the number of composite precipitates, which are precipitates containing Ti and/or Nb and also containing Mn and S, are adjusted to predetermined ranges. As a result, it is possible to achieve excellent cold forgeability while ensuring conventional equivalent properties for preventing the coarsening of crystal grains, and also to achieve excellent impact properties after a surface-hardening heat treatment. Therefore, the case hardened steel of the present invention is useful as a raw material for various kinds of mechanical parts. In addition, use of the case hardened steel of the present invention allows the formation of a part by cutting to be replaced with cold forging, making it possible to achieve lead time shortening and cost reduction in the formation of a part.

MODE FOR CARRYING OUT THE INVENTION

Figure 1:
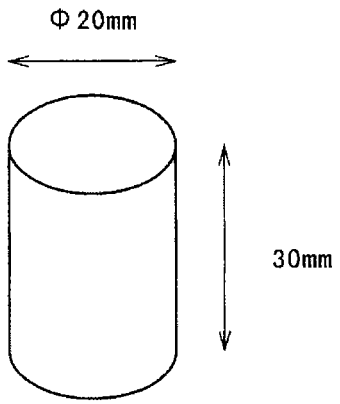
FIG. 1 is a schematic diagram showing the form of a test piece for cold forgeability measurement in the Examples below.

In order to improve the cold forgeability of a case hardened steel and ensure impact properties after a surface-hardening heat treatment, the present inventors have conducted research focusing particularly on the chemical components of a steel and the existence form of precipitates (the size, the number, etc.). As a result, they have found that when the contents of the components C, Si, Mn, S, Cr, Al, Ti, Nb, B, and N are each appropriately controlled, and also the form (size) and the number density of composite precipitates, which are precipitates containing Ti and/or Nb and also containing Mn and S, (hereinafter referred to as "(Ti, Nb)-based composite precipitate") are adjusted to predetermined ranges, improved cold forgeability can be achieved while ensuring conventional equivalent properties for preventing the coarsening of crystal grains, and further impact properties after a surface-hardening heat treatment can also be ensured. The present invention has thus been accomplished.

Hereinafter, the chemical components of the case hardened steel of the present invention will be described.

C: 0.05 to 0.3%

C is an element that is important in ensuring the core hardness necessary as a part. When the content is less than 0.05%, hardness is insufficient, leading to insufficient static strength as a part. Meanwhile, when the C content is too high, hardness is excessively increased, leading to a decrease in forgeability and machinability. Thus, the C content has been specified to be not less than 0.05% and not more than 0.3%. The C content is preferably not less than 0.10%, and more preferably not less than 0.15%. In addition, the C content is preferably not more than 0.27%, and more preferably not more than 0.25%.

Si: 0.01 to 0.6%

Si is an element that improves the softening resistance of the steel material and is effective in suppressing a decrease of the surface hardness of a part after case hardening. Therefore, it is necessary that the Si content is not less than 0.01%. The content is more preferably not less than 0.03%, and still more preferably not less than 0.05%. However, the excessive addition of Si increases the deformation resistance of the raw material, leading to a decrease in forgeability and machinability. Therefore, the Si content is specified to be not more than 0.6%. The content is more preferably not more than 0.55%, and still more preferably not more than 0.5%.

Mn: 0.20 to 1.0%

Mn functions as a deoxidizing agent. It is effective in reducing oxide-type inclusions to increase the internal quality of the steel material and is also effective in significantly enhancing hardenability during case hardening such as carburizing quenching. In addition, Mn forms MnS and causes composite precipitation with carbides, nitrides, or carbon nitrides (hereinafter referred to as "carbides and the like") containing Nb and/or Ti. As a result, the deterioration of cold forgeability due to coarse carbides and the like containing Nb and/or Ti can be suppressed. Further, a low Mn content causes hot shortness, leading to a decrease in productivity. Thus, the Mn content has been specified to be not less than 0.20%. The Mn content is preferably not less than 0.30%, and more preferably not less than 0.35%. Meanwhile, when the Mn content is too high, this has adverse effects including an increase in deformation resistance during cold forging, significant banded segregation which increases the variation of the material quality, etc. Thus, the Mn content has been specified to be not more than 1.0%. The Mn content is preferably not more than 0.85%, and more preferably not more than 0.80%.

S: 0.001 to 0.025%

S is an element that binds to Mn, Ti, or the like to form MnS, TiS, or the like and is necessary to form composite precipitates containing Mn and Ti. Meanwhile, when the S content is too high, impact properties are adversely affected. Thus, the S content has been specified to be 0.001 to 0.025%. The S content is preferably not less than 0.005%, and more preferably not less than 0.010%. In addition, the S content is preferably not more than 0.022%, and more preferably not more than 0.020%.

Cr: 1 to 2.5%

Cr is an element necessary to obtain an effective case during case hardening such as carburizing. Meanwhile, when the Cr content is too high, over-carburizing is caused, whereby the sliding characteristics of a part after case hardening are adversely affected. Thus, the Cr content has been specified to be 1 to 2.5%. The Cr content is preferably not less than 1.2%, and more preferably not less than 1.3%. In addition, the Cr content is preferably not more than 2.2%, and more preferably not more than 2.0% (still more preferably not more than 1.9%).

Al: 0.01 to 0.10%

Al is an element that binds to N to form AlN and is effective in suppressing the growth of crystal grains in the steel material during a heat treatment. In addition, when Al is added in combination with the below-mentioned Ti or Nb, AlN undergoes composite precipitation with precipitates containing Ti or Nb, and this produces more stable preventive effects on the coarsening of crystal grains than in the case of separate precipitation. Meanwhile, when the Al content is too high, the amount of Al solid solution increases, leading to an increase in deformation resistance during cold forging. Thus, the Al content has been specified to be 0.01 to 0.10%. The Al content is preferably not less than 0.02%, and more preferably not less than 0.03%. In addition, the Al content is preferably not more than 0.09%, and more preferably not more than 0.08%.

Ti: 0.01 to 0.10%

Ti produces fine Ti carbides and the like (Ti (C, N)) in the steel and is effective in suppressing the coarsening of crystal grains during case hardening. Meanwhile, when the Ti content is too high, this leads to an increase in the production cost of the steel material or a decrease in cold forgeability and impact properties (impact strength represented by Charpy absorbed energy, etc.) due to the production of coarse Ti-based inclusions. Thus, the Ti content has been specified to be 0.01 to 0.10%. The Ti content is preferably not less than 0.02%, and more preferably not less than 0.03%. In addition, the Ti content is preferably not more than 0.09%, and more preferably not more than 0.08%.

Nb: 0.01 to 0.10%

Nb produces fine Nb carbides and the like (Nb (C, N)) in the steel and is effective in suppressing the coarsening of crystal grains during case hardening. Meanwhile, when the Nb content is too high, this leads to an increase in the production cost of the steel material or a decrease in cold forgeability and impact properties (impact strength, etc.) due to the production of coarse Nb-based inclusions. Thus, the Nb content has been specified to be 0.01 to 0.10%. The Nb content is preferably not less than 0.02%, and more preferably not less than 0.03%. In addition, the Nb content is preferably not more than 0.09%, and more preferably not more than 0.08%.

B: 0.0005 to 0.005%

B is effective in significantly improving the hardenability of the steel material even in a small amount. In addition, B is also effective in strengthening the crystal grain boundary and increasing impact strength. Meanwhile, when the B content is too high, the above effectiveness is saturated, and also B nitrides are likely to be formed, causing the deterioration of cold and hot workability. Thus, the B content has been specified to be 0.0005 to 0.005%. The B content is preferably not less than 0.0007%, and more preferably not less than 0.0010%. In addition, the B content is preferably not more than 0.004%, and more preferably not more than 0.0035%.

N: 0.002 to 0.02%

N is an element necessary to produce nitrides or carbon nitrides with Ti or Nb. However, when the N content is too high, this is likely to cause the coarsening of Ti-based nitrides, resulting in a decrease in impact strength and a decrease in cold forgeability due to increased deformation resistance. Thus, the N content has been specified to be 0.002 to 0.02%. The N content is preferably not less than 0.003%, and more preferably not less than 0.005%. In addition, the N content is preferably not more than 0.018%, and more preferably not more than 0.015%.

The basic components of the case hardened steel of the present invention are as mentioned above, and the balance is substantially iron. However, the presence of unavoidable impurities in the steel, which are introduced depending on the conditions including raw materials, materials, production facilities, etc., is naturally acceptable. Further, in the present invention, without interfering with the operation effects of the present invention, the following optional elements may also be contained. Depending on the kinds of elements contained, the properties of the case hardened steel can be further improved.

Mo: not more than 2% (excluding 0%)

Mo is effective in significantly improving hardenability during case hardening such as carburizing quenching and is also effective in improving impact strength. Thus, the Mo content is preferably not less than 0.01%, and more preferably not less than 0.05%. Meanwhile, when the Mo content is too high, the hardness of the steel material increases, leading to poor machinability. Thus, the Mo content is not more than 2%, more preferably not more than 1.5%, and still more preferably not more than 1.0% (particularly not more than 0.8%).

Cu: not more than 0.1% (excluding 0%) and/or Ni: not more than 0.3% (excluding 0%)

Cu and Ni are each an element that is more resistant to oxidation than Fe and thus improves the corrosion resistance of the steel material. Ni is also effective in improving the impact resistance of the steel material. Thus, the Cu content and the Ni content are each preferably not less than 0.01%, and more preferably not less than 0.05%. Meanwhile, when the Cu content is too high, the hot ductility of the steel material decreases, and when the Ni content is too high, the steel material cost increases. Thus, the Cu content is preferably not more than 0.1%, more preferably not more than 0.08%, and still more preferably not more than 0.05%. The Ni content is preferably not more than 0.3%, more preferably not more than 0.2%, and still more preferably not more than 0.1%. Cu and Ni may be used alone or in combination. However, in the case where Cu is added, it is preferable to also add Ni.

An object of the present invention is to obtain improved cold forgeability together with conventional equivalent properties for preventing the coarsening of crystal grains, and further obtain excellent impact properties after a surface-hardening heat treatment. According to the research of the present inventors, in order to obtain excellent impact properties, it is likely to be necessary to suppress the coarsening of crystal grains. For the suppression of the coarsening of crystal grains, it is necessary to finely disperse Ti and Nb carbides and the like. However, not all Ti and Nb carbides and the like are finely dispersed, and coarse carbides and the like also precipitate. Such coarse carbides and the like are harder than the matrix and adversely affect cold forgeability, and thus are undesirable. Thus, as a result of the research of the present inventors, it has been found that even in the case where carbides and the like are coarse, when they are composite precipitates of MnS with Ti carbides and the like and/or Nb carbides and the like ((Ti, Nb)-based composite precipitates), the deterioration of cold forgeability can be suppressed by MnS that is softer than the matrix.

Specifically, of precipitates containing Ti and/or Nb, the number density of precipitates having a size of more than 5 $\mu m^2$ and less than 20 $\mu m^2$ and containing Mn and S is specified to be more than 0.7/$mm^2$ and not more than 3.0/$mm^2$. The present invention targets at (Ti, Nb)-based composite precipitates having a size of more than 5 $\mu m^2$ and less than 20 $\mu m^2$. This is because properties for preventing the coarsening of crystal grains and cold forgeability are both greatly affected by Ti and/or Nb carbides and the like contained in composite precipitates of this size. That is, precipitates having a size of not more than 5 $\mu m^2$ do not have much effect on cold forgeability. Meanwhile, originally, the adverse effects of precipitates having a size of not less than 20 $\mu m^2$ on cold forgeability are extremely high. Therefore, by improving cold forgeability with precipitates having a size of more than 5 $\mu m^2$ and less than 20 $\mu m^2$, cold forgeability can be improved while maintaining the preventive effects on the coarsening of crystal grains. Although precipitates containing Ti and/or Nb themselves are hard, when (Ti, Nb)-based composite precipitates are formed by composite precipitation with soft MnS, the deformability as one precipitate can be improved. At the same time, owing to the effects of Ti and/or Nb carbides and the like, properties for preventing the coarsening of crystal grains during case hardening can be ensured. In order to sufficiently exhibit the improving effects on cold forgeability and properties for preventing the coarsening of crystal grains, of precipitates containing Ti and/or Nb, the number density of precipitates having a size of more than 5 $\mu m^2$ and less than 20 $\mu m^2$ and containing Mn and S is specified to be more than 0.7/$mm^2$. The number density is preferably not less than 1.0/$mm^2$, more preferably not less than 1.1/$mm^2$, and still more preferably not less than 1.2/$mm^2$. Meanwhile, even when precipitates are like this, excessive precipitation leads to insufficient strength after case hardening. Thus, the number density is specified to be not more than 3.0/$mm^2$. The number density is preferably not more than 2.5/$mm^2$, and more preferably not more than 2.0/$mm^2$. In addition, of precipitates containing Ti and/or Nb, the number density of precipitates having a size of more than 5 $\mu m^2$ and less than 20 $\mu m^2$ and not containing Mn or S is about 1.0 to 10.0/$mm^2$.

In addition, of precipitates containing Ti and/or Nb, precipitates having a size of not less than 20 $\mu m^2$ (the upper limit of the size of precipitates is usually about 30 $\mu m^2$) greatly adversely affect cold forgeability. Therefore, it is necessary to minimize the number of such precipitates. Therefore, of precipitates containing Ti and/or Nb, the number density of precipitates having a size of not less than 20 $\mu m^2$ is specified to be not more than 1.0/$mm^2$. Of precipitates containing Ti and/or Nb, the number density of precipitates having a size of not less than 20 $\mu m^2$ is preferably not more than 0.9/$mm^2$, and more preferably not more than 0.8/$mm^2$. Incidentally, as long as the component system of the present invention and the below-mentioned production method are used, of precipitates containing Ti and/or Nb, precipitates having a size of not less than 20 $\mu m^2$ usually do not contain Mn or S. However, the presence of Mn and S has no adverse effect and is also within the range of the present invention. The number of precipitates having a size of not less than 20 $\mu m^2$ can be controlled by adjusting the amount of Ti and/or Nb added to the steel or by adjusting the heating temperature and heating time before blooming, the working temperature during hot rolling, and the like in the below-mentioned production method.

Incidentally, in the prior art, the number density of precipitates containing Ti and/or Nb and having a size of not more than 5 $\mu m^2$ (and not less than 2 $\mu m^2$ as described in the Examples below) is as follows: (i) composite precipitates containing Mn and S: about 0.0 to 0.5/$mm^2$ and (ii) precipitates not containing Mn or S: about 0.1 to 1.5/$mm^2$.

The case hardened steel of the present invention has a ferrite fraction of more than 77% by area. This is because when the ferrite fraction is low, cold forgeability is impaired. The ferrite fraction is preferably not less than 80% by area, more preferably not less than 82% by area, and still more preferably not less than 83% by area. In addition, the remaining structure other than the ferrite structure includes pearlite, bainite, martensite, etc., for example.

In the production of the case hardened steel of the present invention, in the series of steps including ingoting, casting, soaking, blooming, and hot rolling, it is particularly important that the cooling rate during casting is so high that the soaking temperature before blooming does not become too high. It is also important that hot rolling is performed in two states, and the temperature range in each stage is appropriately controlled. The detailed conditions of each step are as follows.

In casting, it is important to finely disperse MnS crystallized during cooling. Specifically, the cooling rate from 1500° C. to 800° C. during casting should be not less than 2.5° C./min. A cooling rate of not less than 2.5° C./min may be achieved, for example, by increasing the amount of mist, which is sprayed in the cooling zone during continuous casting, than usual. The cooling rate is preferably not less than 2.8° C./min, and more preferably not less than 3.0° C./min.

In heating before blooming (soaking), it is important to prevent the dissolution of MnS that has been finely dispersed at the time of cooling during casting, and the heating (soaking) temperature should be 1100 to 1200° C. The heating temperature is preferably not more than 1180° C., and more preferably not more than 1170° C. In addition, after blooming, cooling to room temperature is performed preferably at a rate of not more than 5° C./sec, and more preferably at a rate of not more than 3° C./sec. The heating time is not particularly limited, and is about 0 to 100 minutes at the soaking temperature, for example.

In hot rolling, it is important to perform rolling in two stages at different temperature ranges. In the first stage, MnS finely dispersed during casting is allowed to undergo composite precipitation with Ti and/or Nb carbides and the like. In the second stage, the ferrite fraction is ensured. Specifically, first hot rolling is performed at a working temperature of 970 to 1150° C., followed by cooling to $Ac_3$ to 950° C., and then second hot rolling is performed at a working temperature of $Ac_3$ to 950° C. The first working temperature is preferably 1000 to 1130° C., and more preferably 1020 to 1100° C. In addition, the second working temperature is preferably 800 to 930° C. The cooling rate from the first working temperature to the second working temperature is not particularly limited, and is about 10° C./sec, for example. It is preferable that the cooling rate after second rolling is not more than 5° C./sec so that no bainite or martensite is produced.

Examples

Hereinafter, the present invention will be described in further detail through examples. The present invention is not limited to the following examples, and, needless to say, any modification in the range of the purpose described above or below is within the technical scope of the present invention.

The steels having the chemical components shown in Tables 1 to 3 were ingoted in accordance with an ordinary ingoting method, cast, soaked, and hot forged (the blooming mentioned above was simulated), followed by cooling to room temperature (cooling rate: 5° C./sec). Subsequently, after reheating, first forging was performed (the first hot rolling mentioned above was simulated), followed by cooling to the second forging temperature (the second hot rolling mentioned above was simulated), and then second forging was performed, followed by cooling to room temperature (cooling rate: 5° C./sec), thereby giving a steel bar of 30 mm in diameter. The cooling rate (° C./min) during casting, the soaking temperature (° C.), the soaking time (min), and the first and second forging temperatures (° C.) are shown in Tables 1 to 3.

TABLE 1

| | Chemical Components (% by mass) * The balance: iron and unavoidable impurities | | | | | | | | | | | | | Production Conditions | | | | |
|---|---|---|---|---|---|---|---|---|---|---|---|---|---|---|---|---|---|---|
| | | | | | | | | | | | | | | | Blooming | | Hot Rolling | |
| No. | C | Si | Mn | S | Cr | Al | Ti | Nb | B | N | Mo | Cu | Ni | Casting Cooling Rate (° C./min) | Soaking Temperature (° C.) | Soaking Time (min) | First Forging Temperature (° C.) | Second Forging Temperature (° C.) |
| 1 | 0.19 | 0.07 | 0.73 | 0.011 | 1.94 | 0.031 | 0.040 | 0.040 | 0.0012 | 0.0050 | 0.08 | | | 2.5 | 1100 | 60 | 1000 | 950 |
| 2 | 0.18 | 0.05 | 0.46 | 0.010 | 1.42 | 0.030 | 0.038 | 0.075 | 0.0014 | 0.0036 | | | | 3.0 | 1100 | 60 | 1000 | 950 |
| 3 | 0.21 | 0.36 | 0.44 | 0.008 | 1.40 | 0.029 | 0.056 | 0.076 | 0.0018 | 0.0062 | 0.11 | | | 2.5 | 1100 | 60 | 1050 | 900 |
| 4 | 0.21 | 0.40 | 0.40 | 0.007 | 1.61 | 0.030 | 0.056 | 0.079 | 0.0170 | 0.0073 | 0.10 | | | 2.5 | 1100 | 60 | 1050 | 900 |
| 5 | 0.19 | 0.05 | 0.52 | 0.010 | 1.66 | 0.082 | 0.083 | 0.072 | 0.0012 | 0.0088 | | | | 3.5 | 1100 | 60 | 1000 | 950 |
| 6 | 0.18 | 0.08 | 0.60 | 0.012 | 1.89 | 0.029 | 0.046 | 0.049 | 0.0011 | 0.0045 | | | | 2.5 | 1100 | 60 | 1000 | 950 |
| 7 | 0.19 | 0.08 | 0.47 | 0.009 | 1.39 | 0.065 | 0.034 | 0.064 | 0.0008 | 0.0033 | | | | 2.5 | 1100 | 60 | 1000 | 925 |
| 8 | 0.17 | 0.09 | 0.57 | 0.017 | 1.65 | 0.089 | 0.039 | 0.079 | 0.0024 | 0.0151 | | | | 3.0 | 1100 | 60 | 1050 | 925 |
| 9 | 0.18 | 0.07 | 0.69 | 0.013 | 1.45 | 0.079 | 0.033 | 0.032 | 0.0019 | 0.0081 | | | | 2.5 | 1100 | 60 | 1050 | 950 |
| 10 | 0.19 | 0.01 | 0.58 | 0.017 | 1.60 | 0.049 | 0.034 | 0.081 | 0.0009 | 0.0108 | | | | 3.0 | 1100 | 60 | 1000 | 900 |
| 11 | 0.18 | 0.09 | 0.66 | 0.018 | 1.56 | 0.065 | 0.083 | 0.048 | 0.0008 | 0.0119 | | | | 3.0 | 1100 | 60 | 1000 | 950 |
| 12 | 0.18 | 0.09 | 0.71 | 0.019 | 1.78 | 0.056 | 0.083 | 0.052 | 0.0006 | 0.0146 | | | | 3.0 | 1100 | 60 | 1000 | 950 |
| 13 | 0.19 | 0.09 | 0.71 | 0.018 | 1.62 | 0.059 | 0.075 | 0.074 | 0.0028 | 0.0148 | | | | 3.0 | 1100 | 60 | 1050 | 950 |
| 14 | 0.18 | 0.02 | 0.56 | 0.014 | 1.76 | 0.051 | 0.057 | 0.073 | 0.0008 | 0.0089 | | | | 2.5 | 1100 | 60 | 1050 | 950 |
| 15 | 0.18 | 0.07 | 0.67 | 0.020 | 1.65 | 0.089 | 0.082 | 0.029 | 0.0027 | 0.0141 | | | | 2.5 | 1100 | 60 | 1050 | 950 |

TABLE 1-continued

| | Chemical Components (% by mass) * The balance: iron and unavoidable impurities | | | | | | | | | | | | | Production Conditions | | | | |
|---|---|---|---|---|---|---|---|---|---|---|---|---|---|---|---|---|---|---|
| | | | | | | | | | | | | | | | Blooming | | Hot Rolling | |
| No. | C | Si | Mn | S | Cr | Al | Ti | Nb | B | N | Mo | Cu | Ni | Casting Cooling Rate (° C./min) | Soaking Temperature (° C.) | Soaking Time (min) | First Forging Temperature (° C.) | Second Forging Temperature (° C.) |
| 16 | 0.17 | 0.40 | 0.47 | 0.020 | 1.84 | 0.038 | 0.049 | 0.051 | 0.0025 | 0.0133 | | | | 2.5 | 1100 | 60 | 1050 | 900 |
| 17 | 0.18 | 0.44 | 0.45 | 0.019 | 1.65 | 0.039 | 0.055 | 0.038 | 0.0017 | 0.0048 | | | | 2.5 | 1100 | 60 | 1000 | 950 |
| 18 | 0.18 | 0.04 | 0.67 | 0.017 | 1.55 | 0.033 | 0.084 | 0.078 | 0.0038 | 0.0089 | | | | 3.5 | 1100 | 45 | 1000 | 925 |
| 19 | 0.18 | 0.10 | 0.64 | 0.015 | 1.70 | 0.070 | 0.063 | 0.088 | 0.0016 | 0.0172 | | | | 3.0 | 1100 | 45 | 1000 | 925 |
| 20 | 0.19 | 0.09 | 0.63 | 0.009 | 1.85 | 0.082 | 0.033 | 0.078 | 0.0022 | 0.0079 | | | | 2.5 | 1100 | 45 | 1000 | 950 |
| 21 | 0.17 | 0.07 | 0.67 | 0.016 | 1.49 | 0.043 | 0.079 | 0.082 | 0.0027 | 0.0170 | | | | 2.5 | 1100 | 45 | 1050 | 950 |
| 22 | 0.19 | 0.02 | 0.48 | 0.018 | 1.36 | 0.086 | 0.087 | 0.082 | 0.0014 | 0.0094 | 0.12 | | | 3.0 | 1100 | 60 | 1050 | 900 |
| 23 | 0.19 | 0.37 | 0.70 | 0.011 | 1.79 | 0.077 | 0.064 | 0.071 | 0.0007 | 0.0107 | | | | 2.5 | 1100 | 60 | 1050 | 950 |
| 24 | 0.18 | 0.06 | 0.61 | 0.016 | 1.61 | 0.063 | 0.063 | 0.031 | 0.0023 | 0.0088 | | | | 2.5 | 1100 | 60 | 1050 | 950 |
| 25 | 0.18 | 0.02 | 0.61 | 0.011 | 1.42 | 0.040 | 0.040 | 0.029 | 0.0022 | 0.0039 | | | | 2.5 | 1100 | 60 | 1000 | 950 |
| 26 | 0.20 | 0.10 | 0.65 | 0.020 | 1.85 | 0.029 | 0.072 | 0.052 | 0.0011 | 0.0038 | | | | 3.5 | 1100 | 60 | 1050 | 950 |

TABLE 2

| | Chemical Components (% by mass) * The balance: iron and unavoidable impurities | | | | | | | | | | | | | Production Conditions | | | | |
|---|---|---|---|---|---|---|---|---|---|---|---|---|---|---|---|---|---|---|
| | | | | | | | | | | | | | | | Blooming | | Hot Rolling | |
| | | | | | | | | | | | | | | | | | First | Second |
| No. | C | Si | Mn | S | Cr | Al | Ti | Nb | B | N | Mo | Cu | Ni | Casting Cooling Rate (° C./min) | Soaking Temperature (° C.) | Soaking Time (min) | Forging Temperature (° C.) | Forging Temperature (° C.) |
| 27 | 0.18 | 0.05 | 0.74 | 0.019 | 1.84 | 0.033 | 0.039 | 0.051 | 0.0032 | 0.0128 | | | | 3.0 | 1100 | 60 | 1050 | 950 |
| 28 | 0.19 | 0.40 | 0.79 | 0.009 | 1.60 | 0.043 | 0.071 | 0.035 | 0.0005 | 0.0155 | | | | 2.5 | 1100 | 60 | 1000 | 950 |
| 29 | 0.18 | 0.05 | 0.68 | 0.017 | 1.37 | 0.033 | 0.045 | 0.049 | 0.0020 | 0.0146 | | | | 3.0 | 1100 | 45 | 1000 | 950 |
| 30 | 0.19 | 0.07 | 0.71 | 0.012 | 1.33 | 0.049 | 0.070 | 0.062 | 0.0022 | 0.0089 | | | | 2.5 | 1100 | 45 | 1050 | 950 |
| 31 | 0.20 | 0.08 | 0.66 | 0.011 | 1.44 | 0.039 | 0.077 | 0.037 | 0.0009 | 0.0058 | | | | 2.5 | 1100 | 45 | 1050 | 950 |
| 32 | 0.18 | 0.08 | 0.80 | 0.012 | 1.33 | 0.087 | 0.036 | 0.073 | 0.0023 | 0.0144 | | | | 3.0 | 1100 | 45 | 1000 | 950 |
| 33 | 0.18 | 0.35 | 0.77 | 0.015 | 1.56 | 0.087 | 0.033 | 0.088 | 0.0012 | 0.0173 | | | 0.20 | 3.0 | 1100 | 60 | 1000 | 950 |
| 34 | 0.18 | 0.03 | 0.73 | 0.014 | 1.44 | 0.058 | 0.059 | 0.078 | 0.0039 | 0.0117 | | | | 3.5 | 1100 | 60 | 1000 | 950 |
| 35 | 0.19 | 0.09 | 0.46 | 0.012 | 1.68 | 0.087 | 0.032 | 0.033 | 0.0009 | 0.0085 | | | | 2.5 | 1100 | 60 | 1000 | 950 |
| 36 | 0.18 | 0.06 | 0.48 | 0.016 | 1.89 | 0.063 | 0.049 | 0.039 | 0.0014 | 0.0105 | | 0.05 | | 2.5 | 1175 | 60 | 1125 | 950 |
| 37 | 0.18 | 0.02 | 0.62 | 0.008 | 1.75 | 0.076 | 0.049 | 0.062 | 0.0009 | 0.0060 | | | | 3.5 | 1100 | 60 | 1125 | 950 |
| 38 | 0.21 | 0.09 | 0.82 | 0.008 | 1.28 | 0.060 | 0.066 | 0.041 | 0.0018 | 0.0057 | | | | 3.5 | 1100 | 60 | 1000 | 950 |
| 39 | 0.21 | 0.07 | 0.72 | 0.015 | 1.49 | 0.073 | 0.068 | 0.028 | 0.0012 | 0.0080 | | | | 3.0 | 1100 | 60 | 1000 | 950 |
| 40 | 0.17 | 0.08 | 0.64 | 0.012 | 1.55 | 0.049 | 0.060 | 0.048 | 0.0026 | 0.0100 | 0.23 | | | 3.0 | 1100 | 60 | 1000 | 950 |
| 41 | 0.21 | 0.07 | 0.53 | 0.019 | 1.72 | 0.035 | 0.088 | 0.056 | 0.0035 | 0.0048 | | | | 3.0 | 1100 | 60 | 1000 | 950 |
| 42 | 0.19 | 0.04 | 0.48 | 0.017 | 1.61 | 0.080 | 0.061 | 0.059 | 0.0020 | 0.0050 | 0.11 | | | 2.5 | 1100 | 60 | 1000 | 950 |
| 43 | 0.20 | 0.07 | 0.48 | 0.017 | 1.31 | 0.075 | 0.090 | 0.070 | 0.0032 | 0.0045 | 0.08 | | | 2.5 | 1100 | 60 | 1000 | 950 |
| 44 | 0.21 | 0.04 | 0.41 | 0.008 | 1.22 | 0.059 | 0.087 | 0.038 | 0.0008 | 0.0071 | 0.10 | | | 2.5 | 1100 | 60 | 1000 | 950 |
| 45 | 0.20 | 0.04 | 0.42 | 0.015 | 1.42 | 0.068 | 0.055 | 0.077 | 0.0011 | 0.0066 | 0.38 | 0.08 | 0.06 | 2.5 | 1100 | 60 | 1000 | 950 |
| 46 | 0.20 | 0.06 | 0.70 | 0.015 | 1.36 | 0.043 | 0.079 | 0.045 | 0.0007 | 0.0174 | 0.25 | 0.04 | | 3.0 | 1100 | 60 | 1000 | 950 |
| 47 | 0.20 | 0.02 | 0.48 | 0.011 | 1.82 | 0.050 | 0.045 | 0.071 | 0.0005 | 0.0081 | | | | 3.0 | 1100 | 60 | 1000 | 950 |
| 48 | 0.18 | 0.09 | 0.46 | 0.014 | 1.71 | 0.036 | 0.090 | 0.071 | 0.0039 | 0.0167 | | | | 3.0 | 1100 | 60 | 1000 | 950 |
| 49 | 0.18 | 0.09 | 0.57 | 0.016 | 1.40 | 0.080 | 0.075 | 0.063 | 0.0037 | 0.0116 | | | | 3.0 | 1100 | 60 | 1000 | 900 |

TABLE 3

| | Chemical Components (% by mass) * The balance: iron and unavoidable impurities | | | | | | | | | | | | | Production Conditions | | | | |
|---|---|---|---|---|---|---|---|---|---|---|---|---|---|---|---|---|---|---|
| | | | | | | | | | | | | | | | Blooming | | Hot Rolling | |
| | | | | | | | | | | | | | | | | | First | Second |
| No. | C | Si | Mn | S | Cr | Al | Ti | Nb | B | N | Mo | Cu | Ni | Casting Cooling Rate (° C./min) | Soaking Temperature (° C.) | Soaking Time (min) | Forging Temperature (° C.) | Forging Temperature (° C.) |
| 50 | 0.21 | 0.07 | 1.22 | 0.013 | 1.04 | 0.109 | 0.010 | 0.040 | 0.0006 | 0.0190 | 0.17 | 0.06 | 0.04 | 2.5 | 1100 | 60 | — | 950 |
| 51 | 0.21 | 0.35 | 0.44 | 0.008 | 1.40 | 0.029 | 0.056 | 0.076 | 0.0018 | 0.0062 | 0.11 | | | 3.0 | 1100 | 60 | — | 1100 |
| 52 | 0.20 | 0.08 | 0.45 | 0.007 | 1.02 | 0.033 | 0.062 | 0.072 | 0.0015 | 0.0068 | | | 0.01 | 3.0 | 1250 | 60 | — | 950 |
| 53 | 0.23 | 9.00 | 0.80 | 0.006 | 1.52 | 0.037 | 0.118 | 0.023 | 0.0012 | 0.0058 | 0.08 | | | 3.0 | 1100 | 60 | — | 950 |
| 54 | 0.18 | 0.07 | 0.28 | 0.012 | 3.12 | 0.038 | 0.059 | 0.066 | 0.0028 | 0.0062 | | | | 3.0 | 1100 | 60 | — | 950 |
| 55 | 0.21 | 0.05 | 0.62 | 0.015 | 1.35 | 0.040 | 0.081 | 0.126 | 0.0021 | 0.0068 | | | | 3.0 | 1100 | 60 | — | 950 |
| 56 | 0.18 | 0.05 | 0.74 | 0.019 | 1.84 | 0.033 | 0.039 | 0.051 | 0.0032 | 0.0128 | | | | 3.0 | 1100 | 60 | — | 950 |
| 57 | 0.18 | 0.03 | 0.73 | 0.014 | 1.44 | 0.058 | 0.059 | 0.078 | 0.0039 | 0.0117 | | | | 3.0 | 1100 | 60 | — | 950 |
| 58 | 0.19 | 0.07 | 0.45 | 0.018 | 1.06 | 0.028 | 0.044 | 0.021 | 0.0027 | 0.0046 | | | | 2.0 | 1000 | 60 | — | 950 |
| 59 | 0.20 | 0.24 | 0.80 | 0.009 | 1.00 | 0.059 | 0.012 | 0.040 | 0.0030 | 0.0196 | | | | 2.5 | 1320 | 180 | 1000 | 900 |
| 60 | 0.21 | 0.06 | 0.42 | 0.007 | 1.27 | 0.030 | 0.060 | 0.070 | 0.0018 | 0.0060 | | | | 3.0 | 1300 | 30 | — | 950 |
| 61 | 0.20 | 0.13 | 0.50 | 0.012 | 1.07 | 0.015 | 0.069 | 0.087 | 0.0012 | 0.0054 | | | | 2.5 | 1250 | 150 | — | 900 |

The obtained steel bar was subjected to measurement using the following methods.

(1) Measurement of Precipitates A longitudinal cross-section (plane parallel to the shaft center) of the obtained steel bar in the D/4 position (D is the diameter of the steel bar) was polished, and an arbitrary 10 mm×10 mm region was subjected to measurement using automatic EPMA. With respect to inclusions having a size of not less than 2 $\mu m^2$, in the case where the Ti content was not less than 5 mass %, they were judged to "contain Ti", while in the case where the Nb content was not less than 5 mass %, they were judged to "contain Nb". Also for Mn and S, in the case where the contents were each not less than 5 mass %, they were judged to "contain Mn" or "contain S". The detailed measurement conditions are as follows.

EPMA analyzer: JXA-8100 electron microprobe analyzer (manufactured by NEC Corporation)

Analyzer (EDS): System Six (manufactured by Thermo Fisher Scientific K.K.)

Accelerating voltage: 15 kV

Operation current: 4 nA

Observation magnification: ×200

(2) Measurement of Cold Forgeability

Figure 2:
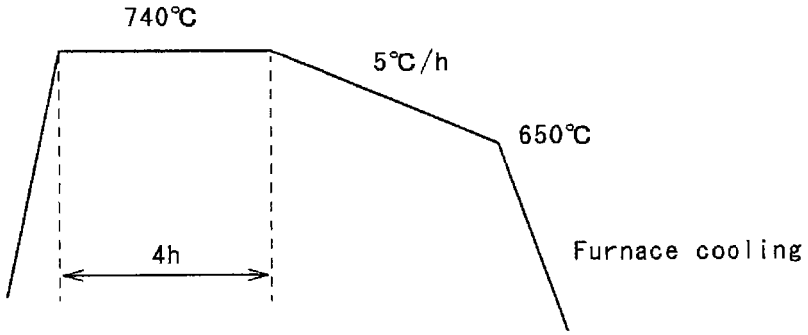
FIG. 2 is a graph showing the heat treatment conditions for spheroidization in the Examples below.

A ϕ20 mm×30 mm test piece was cut from the obtained steel bar as shown in FIG. 1, and subjected to spheroidization shown in FIG. 2, i.e., a heat treatment in which the test piece was heated to 740° C., maintained at the temperature for 4 hours, cooled to 650° C. at a cooling rate of 5° C./h, and then furnace-cooled from 650° C. to room temperature. The spheroidized test piece was subjected to an end-confined compression test at 50% rolling reduction to measure the deformation resistance ($N/mm^2$).

(3) Measurement of Impact Properties

Figure 3:
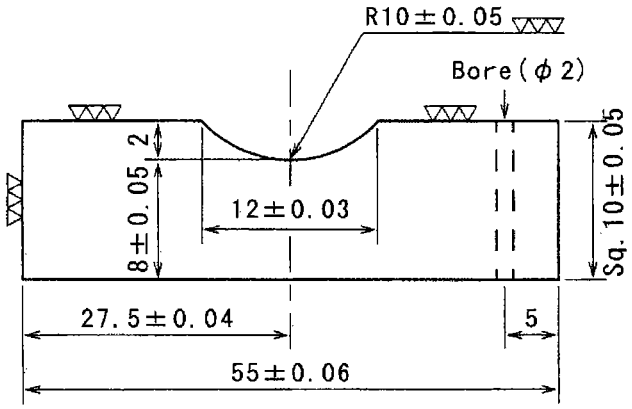
FIG. 3 is a schematic diagram showing the form of a Charpy impact test piece used for the measurement of impact properties in the Examples below.
Figure 4:
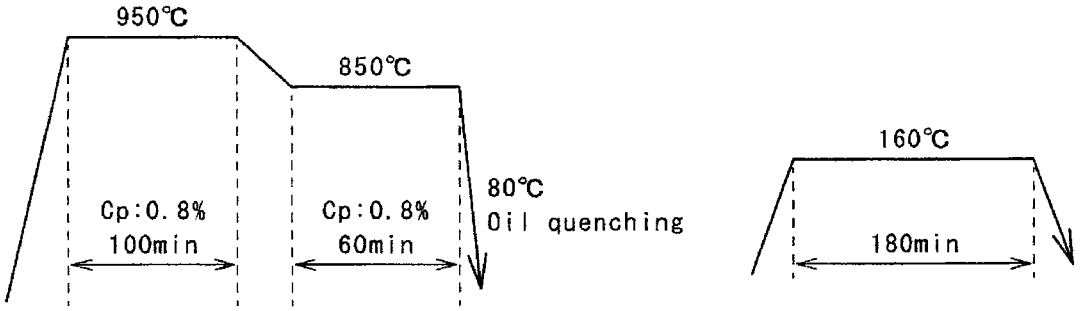
FIG. 4 is a graph showing the carburizing treatment conditions in the Examples below.

A test piece having the shape shown in FIG. 3 was obtained from the obtained steel bar. The test piece was gas-carburized under the carburizing conditions shown in FIG. 4 (carburizing-stage conditions=temperature: 950° C., time: 100 minutes, carbon potential: 0.8%, carburizing gas: propane; diffusion-stage conditions=temperature: 850° C., time: 60 minutes, carbon potential: 0.8%, carburizing gas: propane; quenching conditions=oil cooling to 80° C.), and then tempered at 160° C. for 180 minutes, followed by air cooling. The test piece after tempering was subjected to a Charpy impact test in accordance with JIS Z 2242 at normal temperature to measure the Charpy impact value ($J/cm^2$).

(4) Observation of Structure

The steel bar was embedded in a supporting substrate in such a manner that a longitudinal cross-section (plane parallel to the shaft center) of the steel bar in the D/4 position (D is the diameter of the steel bar) was exposed. After polishing, the steel bar was immersed in a nital solution for about 5 seconds to cause corrosion. Subsequently, a 700 μm×900 μm region was observed and photographed under an optical microscope to identify the structure and measure the area factor.

(5) Measurement of Grain Size

A ϕ20 mm×30 mm columnar test piece was obtained from the steel bar, and the columnar test piece was compressed in the height direction at room temperature (compressibility: 85%, height: 3 mm), followed by carburizing and tempering under the same conditions as in (3) above (conditions given in FIG. 4), and the grain size was measured. The grain size was measured as follows. Using the carburized layer in a cross-section of the carburized and tempered test piece in the position at an equivalent strain of 1.2 as the position of microscopic examination, the cross-section was etched and observed under an optical microscope (magnification: ×200) to determine the grain size number of prior austenite grains in accordance with JIS G 0551.

The results are shown in Tables 4 to 6. Incidentally, Tables 4 to 6 also show the number of, of precipitates containing Ti and/or Nb, those outside the specified range of the present invention.

TABLE 4

| NO. | Deformation Resistance at 50% Compression ($N/mm^2$) | Ferrite Fraction (% by area) | Charpy Impact Value ($J/cm^2$) | Precipitates Containing Ti and/or Nb: Not more than 5 $\mu m^2$ Number Density (the number of precipitates/$mm^2$) With MnS (composite) | Not more than 5 $\mu m^2$ Number Density Without MnS ((Ti, Nb)-based alone) | More than 5 $\mu m^2$ and less than 20 $\mu m^2$ Number Density (the number of precipitates/$mm^2$) With MnS (composite) | More than 5 $\mu m^2$ Number Density Without MnS ((Ti, Nb)-based alone) | Not less than 20 $\mu m^2$ Number Density (the number of precipitates/$mm^2$) With MnS (composite) | Not less than 20 $\mu m^2$ Number Density Without MnS ((Ti, Nb)-based alone) | Grain Size | Average Size ($\mu m^2$), more than 5 $\mu m^2$ without MnS ((Ti, Nb)-based alone) |
|---|---|---|---|---|---|---|---|---|---|---|---|
| 1 | 609 | 80 | 66.0 | 0.1 | 0.2 | 1.2 | 3.5 | 0.0 | 0.1 | 8.0 | 8.6 |
| 2 | 554 | 85 | 79.7 | 0.0 | 0.3 | 1.3 | 6.7 | 0.0 | 0.9 | 8.5 | 11.1 |
| 3 | 601 | 83 | 9.7 | 0.0 | 0.2 | 1.2 | 5.4 | 0.0 | 0.5 | 8.5 | 13.2 |
| 4 | 607 | 82 | 9.8 | 0.0 | 0.1 | 1.3 | 4.7 | 0.0 | 0.8 | 9.0 | 11.6 |
| 5 | 582 | 85 | 61.6 | 0.0 | 0.6 | 1.2 | 9.3 | 0.0 | 0.7 | 9.0 | 10.5 |
| 6 | 572 | 81 | 67.5 | 0.2 | 0.5 | 1.7 | 3.7 | 0.0 | 0.3 | 8.0 | 12.6 |
| 7 | 567 | 84 | 46.3 | 0.2 | 0.7 | 1.6 | 3.7 | 0.0 | 0.9 | 8.5 | 12.3 |
| 8 | 581 | 82 | 53.9 | 0.2 | 0.2 | 1.2 | 5.1 | 0.0 | 0.6 | 9.0 | 11.0 |
| 9 | 565 | 81 | 59.1 | 0.2 | 0.7 | 1.6 | 1.5 | 0.0 | 0.5 | 8.0 | 13.7 |
| 10 | 594 | 81 | 41.2 | 0.0 | 0.4 | 1.7 | 4.6 | 0.0 | 0.3 | 8.0 | 11.6 |
| 11 | 573 | 84 | 81.8 | 0.2 | 0.8 | 1.4 | 7.9 | 0.0 | 0.2 | 8.5 | 8.9 |
| 12 | 591 | 84 | 54.9 | 0.4 | 0.7 | 1.5 | 8.2 | 0.0 | 0.5 | 8.5 | 8.4 |
| 13 | 607 | 82 | 49.1 | 0.3 | 0.6 | 1.6 | 8.8 | 0.0 | 0.5 | 9.0 | 10.0 |
| 14 | 581 | 82 | 43.5 | 0.2 | 1.2 | 1.2 | 6.5 | 0.0 | 0.4 | 8.0 | 12.4 |
| 15 | 592 | 83 | 54.8 | 0.4 | 0.5 | 1.2 | 6.7 | 0.0 | 0.8 | 9.5 | 9.5 |
| 16 | 591 | 85 | 61.1 | 0.3 | 0.9 | 1.6 | 4.5 | 0.0 | 0.6 | 8.5 | 11.9 |
| 17 | 572 | 84 | 69.8 | 0.2 | 1.1 | 1.6 | 4.5 | 0.0 | 0.2 | 8.0 | 8.4 |
| 18 | 565 | 84 | 76.5 | 0.2 | 1.0 | 1.2 | 9.8 | 0.0 | 0.7 | 9.5 | 9.3 |
| 19 | 596 | 83 | 42.1 | 0.2 | 0.6 | 1.1 | 8.1 | 0.0 | 0.0 | 8.0 | 7.2 |
| 20 | 594 | 85 | 63.7 | 0.2 | 1.1 | 1.4 | 4.4 | 0.0 | 0.4 | 9.0 | 11.7 |
| 21 | 582 | 82 | 72.2 | 0.3 | 0.7 | 1.4 | 9.2 | 0.0 | 0.8 | 9.0 | 11.0 |
| 22 | 604 | 84 | 53.9 | 0.1 | 0.8 | 1.2 | 8.2 | 0.0 | 0.8 | 9.0 | 10.5 |
| 23 | 604 | 83 | 50.1 | 0.4 | 0.6 | 1.4 | 7.2 | 0.0 | 0.4 | 8.5 | 8.8 |
| 24 | 574 | 81 | 70.9 | 0.3 | 1.0 | 1.2 | 5.0 | 0.0 | 0.9 | 8.0 | 12.5 |
| 25 | 564 | 83 | 78.4 | 0.2 | 1.1 | 1.9 | 1.9 | 0.0 | 0.7 | 7.5 | 13.3 |
| 26 | 579 | 84 | 50.0 | 0.1 | 0.9 | 1.3 | 7.4 | 0.0 | 0.7 | 8.0 | 12.4 |

TABLE 5

| NO. | Deformation Resistance at 50% Compression ($N/mm^2$) | Ferrite Fraction (% by area) | Charpy Impact Value ($J/cm^2$) | Precipitates Containing Ti and/or Nb: Not more than 5 $\mu m^2$ Number Density (the number of precipitates/$mm^2$) With MnS (composite) | Not more than 5 $\mu m^2$ Number Density Without MnS ((Ti, Nb)-based alone) | More than 5 $\mu m^2$ and less than 20 $\mu m^2$ Number Density (the number of precipitates/$mm^2$) With MnS (composite) | More than 5 $\mu m^2$ Number Density Without MnS ((Ti, Nb)-based alone) | Not less than 20 $\mu m^2$ Number Density (the number of precipitates/$mm^2$) With MnS (composite) | Not less than 20 $\mu m^2$ Number Density Without MnS ((Ti, Nb)-based alone) | Grain Size | Average Size ($\mu m^2$), more than 5 $\mu m^2$ without MnS ((Ti, Nb)-based alone) |
|---|---|---|---|---|---|---|---|---|---|---|---|
| 27 | 598 | 82 | 58.9 | 0.1 | 1.0 | 1.8 | 3.1 | 0.0 | 0.4 | 8.0 | 12.2 |
| 28 | 610 | 80 | 44.8 | 0.1 | 0.7 | 1.2 | 6.4 | 0.0 | 0.8 | 8.0 | 11.0 |
| 29 | 578 | 80 | 46.9 | 0.0 | 0.2 | 1.7 | 3.7 | 0.0 | 0.3 | 7.5 | 12.4 |
| 30 | 570 | 85 | 61.8 | 0.3 | 0.4 | 1.1 | 8.0 | 0.0 | 0.4 | 8.5 | 9.4 |
| 31 | 594 | 85 | 66.0 | 0.3 | 1.1 | 1.2 | 7.2 | 0.0 | 0.7 | 8.5 | 9.8 |
| 32 | 583 | 82 | 60.8 | 0.2 | 0.3 | 1.3 | 4.4 | 0.0 | 0.4 | 8.0 | 10.3 |
| 33 | 600 | 82 | 45.7 | 0.2 | 0.5 | 1.3 | 4.9 | 0.0 | 0.9 | 8.0 | 11.8 |
| 34 | 578 | 84 | 62.4 | 0.4 | 1.3 | 1.1 | 7.6 | 0.0 | 0.1 | 8.5 | 7.2 |
| 35 | 574 | 83 | 44.4 | 0.4 | 0.7 | 1.6 | 1.5 | 0.0 | 0.1 | 7.5 | 10.6 |
| 36 | 578 | 85 | 66.1 | 0.0 | 0.3 | 1.5 | 3.8 | 0.0 | 0.8 | 8.0 | 12.3 |
| 37 | 560 | 81 | 68.6 | 0.0 | 0.4 | 1.2 | 5.2 | 0.0 | 0.6 | 8.5 | 8.9 |
| 38 | 588 | 84 | 49.0 | 0.2 | 0.8 | 1.2 | 5.9 | 0.0 | 0.6 | 8.5 | 12.1 |
| 39 | 596 | 84 | 45.1 | 0.0 | 0.8 | 1.1 | 5.6 | 0.0 | 0.8 | 8.0 | 13.3 |
| 40 | 609 | 82 | 76.2 | 0.3 | 0.7 | 1.3 | 5.7 | 0.0 | 0.0 | 8.5 | 12.5 |
| 41 | 583 | 84 | 43.2 | 0.1 | 1.0 | 1.3 | 8.9 | 0.0 | 0.7 | 8.5 | 12.6 |
| 42 | 584 | 85 | 52.2 | 0.1 | 1.1 | 1.2 | 6.7 | 0.0 | 0.9 | 8.0 | 12.7 |
| 43 | 603 | 84 | 38.2 | 0.0 | 0.2 | 1.2 | 10.0 | 0.0 | 0.1 | 9.5 | 8.2 |
| 44 | 599 | 81 | 42.2 | 0.0 | 0.2 | 1.1 | 8.4 | 0.0 | 0.1 | 8.0 | 7.5 |

TABLE 5-continued

| NO. | Deformation Resistance at 50% Compression (N/mm$^2$) | Ferrite Fraction (% by area) | Charpy Impact Value (J/cm$^2$) | Precipitates Containing Ti and/or Nb: Not more than 5 μm$^2$ Number Density (the number of precipitates/mm$^2$) With MnS (composite) | Not more than 5 μm$^2$ Number Density Without MnS ((Ti, Nb)-based alone) | More than 5 μm$^2$ and less than 20 μm$^2$ Number Density (the number of precipitates/mm$^2$) With MnS (composite) | More than 5 μm$^2$ Number Density Without MnS ((Ti, Nb)-based alone) | Not less than 20 μm$^2$ Number Density (the number of precipitates/mm$^2$) With MnS (composite) | Not less than 20 μm$^2$ Number Density Without MnS ((Ti, Nb)-based alone) | Grain Size | Average Size (μm$^2$), more than 5 μm$^2$ without MnS ((Ti, Nb)-based alone) |
|---|---|---|---|---|---|---|---|---|---|---|---|
| 45 | 601 | 81 | 43.2 | 0.1 | 0.8 | 1.1 | 7.3 | 0.0 | 0.8 | 8.5 | 11.5 |
| 46 | 594 | 80 | 45.2 | 0.1 | 0.9 | 1.0 | 7.5 | 0.0 | 0.8 | 8.5 | 11.3 |
| 47 | 599 | 83 | 37.4 | 0.4 | 1.4 | 1.5 | 4.9 | 0.0 | 0.9 | 8.5 | 12.9 |
| 48 | 588 | 84 | 43.8 | 0.0 | 0.7 | 1.3 | 10.0 | 0.0 | 0.8 | 9.5 | 11.8 |
| 49 | 568 | 82 | 55.4 | 0.1 | 0.1 | 1.2 | 8.1 | 0.0 | 0.6 | 9.0 | 10.2 |

based composite precipitates having a size of more than 5 μm$^2$

TABLE 6

| NO. | Deformation Resistance at 50% Compression (N/mm$^2$) | Ferrite Fraction (% by area) | Charpy Impact Value (J/cm$^2$) | Precipitates Containing Ti and/or Nb: Not more than 5 μm$^2$ Number Density (the number of precipitates/mm$^2$) With MnS (composite) | Not more than 5 μm$^2$ Number Density Without MnS ((Ti, Nb)-based alone) | More than 5 μm$^2$ and less than 20 μm$^2$ Number Density (the number of precipitates/mm$^2$) With MnS (composite) | More than 5 μm$^2$ Number Density Without MnS ((Ti, Nb)-based alone) | Not less than 20 μm$^2$ Number Density (the number of precipitates/mm$^2$) With MnS (composite) | Not less than 20 μm$^2$ Number Density Without MnS ((Ti, Nb)-based alone) | Grain Size | Average Size (μm$^2$), more than 5 μm$^2$ without MnS ((Ti, Nb)-based alone) |
|---|---|---|---|---|---|---|---|---|---|---|---|
| 50 | 659 | 75 | 19.7 | 0.4 | 0.1 | 0.7 | 0.4 | 0.3 | 0.3 | 6.0 | 14.8 |
| 51 | 680 | 65 | 42.0 | 0.0 | 0.3 | 0.3 | 7.9 | 0.3 | 1.4 | 8.5 | 13.9 |
| 52 | 662 | 72 | 36.1 | 0.0 | 0.6 | 0.5 | 8.5 | 0.1 | 0.2 | 8.5 | 9.7 |
| 53 | 638 | 65 | 44.9 | 0.2 | 1.8 | 0.7 | 10.9 | 0.2 | 1.2 | 8.5 | 12.4 |
| 54 | 642 | 78 | 26.6 | 0.1 | 0.4 | 0.5 | 7.9 | 0.1 | 0.4 | 8.0 | 10.7 |
| 55 | 621 | 63 | 6.7 | 0.2 | 1.2 | 0.7 | 13.4 | 0.1 | 0.3 | 8.0 | 8.1 |
| 56 | 623 | 78 | 32.0 | 0.0 | 0.8 | 0.1 | 4.2 | 0.0 | 0.3 | 8.0 | 11.6 |
| 57 | 586 | 77 | 4.3 | 0.4 | 0.3 | 0.8 | 8.3 | 0.7 | 0.2 | 8.0 | 10.1 |
| 58 | 632 | 80 | 6.8 | 0.0 | 1.2 | 0.2 | 3.2 | 0.0 | 0.8 | 7.5 | 14.6 |
| 59 | 689 | 85 | 34.7 | 0.0 | 2.5 | 0.3 | 0.7 | 0.0 | 1.3 | 6.5 | 14.4 |
| 60 | 619 | 78 | 21.8 | 0.0 | 0.4 | 0.1 | 8.1 | 0.0 | 0.2 | 8.5 | 8.9 |
| 61 | 638 | 81 | 24.0 | 0.0 | 1.4 | 0.1 | 10.0 | 0.0 | 4.0 | 8.0 | 13.4 |

In Nos. 1 to 49, the component composition and the production method are appropriately controlled. Therefore, (Ti, Nb)-based composite precipitates having a size of more than 5 μm$^2$ and less than 20 μm$^2$ and (Ti, Nb)-based precipitates having a size of not less than 20 μm$^2$ satisfy the requirements of the present invention, and also the ferrite fraction is more than 77% by area. As a result, excellent cold forgeability and impact properties are achieved. Incidentally, as shown in Tables 4 to 6, none of (Ti, Nb)-based precipitates having a size of not less than 20 μm$^2$ in Nos. 1 to 49 contained Mn and S.

Meanwhile, In Nos. 50 to 61, at least either of the component composition and the production method did not satisfy the requirements of the present invention. As a result, at least either of cold forgeability and impact properties was insufficient.

In No. 50, the Mn and Al contents were high, and also forging, which is equivalent to hot rolling, was performed only under the second conditions. Therefore, (Ti, Nb)-based composite precipitates having a size of more than 5 μm$^2$ and less than 20 μm$^2$ and the ferrite fraction were insufficient, resulting in insufficient cold forgeability.

In No. 51, first forging was not performed, and also the second forging temperature was high. Therefore, (Ti, Nb)-based composite precipitates having a size of more than 5 μm$^2$ and less than 20 μm$^2$ and the ferrite fraction were insufficient, and also (Ti, Nb)-based precipitate having a size of not less than 20 μm$^2$ were excessively formed, resulting in insufficient cold forgeability.

In No. 52, the soaking temperature before forging, which is equivalent to blooming, was high, and also first forging, which is equivalent to hot rolling, was not performed. Therefore, (Ti, Nb)-based composite precipitates having a size of more than 5 μm$^2$ and less than 20 μm$^2$ and the ferrite fraction were insufficient, resulting in insufficient cold forgeability.

In No. 53, the Ti content was high, and also first forging, which is equivalent to hot rolling, was not performed. Therefore, (Ti, Nb)-based composite precipitates having a size of more than 5 μm$^2$ and less than 20 μm$^2$ and the ferrite fraction were insufficient, and also (Ti, Nb)-based precipitate having a size of not less than 20 μm$^2$ were excessively formed, resulting in insufficient cold forgeability.

In No. 54, the Cr content was high, and also first forging, which is equivalent to hot rolling, was not performed. Therefore, (Ti, Nb)-based composite precipitates having a size of more than 5 μm$^2$ and less than 20 μm$^2$ were insufficient, resulting in insufficient cold forgeability. In No. 55, the Nb content was high, and also first forging, which is equivalent to hot rolling, was not performed. Therefore, (Ti, Nb)-based composite precipitates having a size of more than 5 $\mu m^2$ and less than 20 $\mu m^2$ and the ferrite fraction were insufficient, resulting in insufficient cold forgeability and impact properties.

In No. 56, first forging, which is equivalent to hot rolling, was not performed. Therefore, (Ti, Nb)-based composite precipitates having a size of more than 5 $\mu m^2$ and less than 20 $\mu m^2$ and the ferrite fraction were insufficient, resulting in insufficient cold forgeability.

In No. 57, first forging, which is equivalent to hot rolling, was not performed. Therefore, the ferrite fraction was insufficient, resulting in insufficient impact properties.

In No. 58, the cooling rate during casting was low, the soaking temperature before forging, which is equivalent to blooming, was high, and also first forging, which is equivalent to hot rolling, was not performed. Therefore, (Ti, Nb)-based composite precipitates having a size of more than 5 $\mu m^2$ and less than 20 $\mu m^2$ were insufficient, resulting in insufficient cold forgeability and impact properties.

In No. 59, the soaking temperature before forging, which is equivalent to blooming, was high. Therefore, (Ti, Nb)-based composite precipitates having a size of more than 5 $\mu m^2$ and less than 20 $\mu m^2$ were insufficient, and also (Ti, Nb)-based precipitate having a size of not less than 20 $\mu m^2$ were excessively formed, resulting in insufficient cold forgeability.

In Nos. 60 and 61, the soaking temperature before forging, which is equivalent to blooming, was high, and also first forging, which is equivalent to hot rolling, was not performed. Therefore, in both cases, (Ti, Nb)-based composite precipitates having a size of more than 5 $\mu m^2$ and less than 20 $\mu m^2$ were insufficient. Further, in No. 61, (Ti, Nb)-based precipitates having a size of not less than 20 $\mu m^2$ were excessively formed. As a result, in both cases, cold forgeability was insufficient.

The invention claimed is:

1. A case hardened steel comprising, in mass %:

C: 0.05 to 0.3%,
Si: 0.01 to 0.6%,
Mn: 0.20 to 1.0%,
S: 0.001 to 0.025%,
Cr: 1 to 2.5%,
Al: 0.01 to 0.10%,
Ti: 0.01 to 0.10%,
Nb: 0.01 to 0.10%,
B: 0.0005 to 0.005%,
N: 0.002 to 0.02%, and
iron, wherein:

a number density of precipitates that comprise Ti, Nb, or both and have a size of not less than 20 $\mu m^2$ is not more than 1.0/$mm^2$, a number density of precipitates that comprise Mn, S, and at least one of Ti and Nb and have a size of more than 5 $\mu m^2$ and less than 20 $\mu m^2$ is more than 0.7/$mm^2$ and not more than 3.0/$mm^2$, and a ferrite fraction is more than 77% by area.

2. The case hardened steel according to claim 1, further comprising Mo: more than 0% but not more than 2%.

3. The case hardened steel according to claim 1, further comprising at least one of (i) Cu: more than 0% but not more than 0.1% and (ii) Ni: more than 0% but not more than 0.3%.

4. A method for producing a case hardened steel, the method comprising:

subjecting a steel comprising, in mass %:

C: 0.05 to 0.3%,
Si: 0.01 to 0.6%,
Mn: 0.20 to 1.0%.
S: 0.001 to 0.025%,
Cr: 1 to 2.5%,
Al: 0.01 to 0.10%,
Ti: 0.01 to 0.10%,
Nb: 0.01 to 0.10%,
B: 0.0005 to 0.005%,
N: 0.002 to 0.02%, and
iron to casting at a cooling rate of not less than 2.5° C./min from 1500° C. to 800° C., blooming at a heating temperature of 1100 to 1200° C., first hot rolling at a rolling temperature of 970 to 1150° C. and then cooling to $Ac_3$ to 950° C., and a second hot rolling at a rolling temperature of $Ac_3$ to 950° C., thereby obtaining the case hardened steel.

* * * * *